US008721401B2

(12) United States Patent
Jiang et al.

(10) Patent No.: US 8,721,401 B2
(45) Date of Patent: May 13, 2014

(54) METHOD FOR CLEANING A POLISHING PAD

(75) Inventors: Li Jiang, Shanghai (CN); Mingqi Li, Shanghai (CN)

(73) Assignee: Semiconductor Manufacturing International (Shanghai) Corporation, Shanghai (CN)

( * ) Notice: Subject to any disclaimer, the term of this patent is extended or adjusted under 35 U.S.C. 154(b) by 377 days.

(21) Appl. No.: 13/163,667

(22) Filed: Jun. 17, 2011

(65) Prior Publication Data

US 2012/0164922 A1 Jun. 28, 2012

(30) Foreign Application Priority Data

Dec. 23, 2010 (CN) ..... 2010 1 0604743

(51) Int. Cl.
*B24B 53/017* (2012.01)
*B24B 53/00* (2006.01)

(52) U.S. Cl.
USPC ..... 451/444; 451/56

(58) Field of Classification Search
None
See application file for complete search history.

(56) References Cited

U.S. PATENT DOCUMENTS 5,876,508 A * 3/1999 Wu et al. ..... 134/2
6,190,237 B1 * 2/2001 Huynh et al. ..... 451/41
6,984,582 B2 * 1/2006 Fukushima et al. ..... 438/633
7,745,809 B1 * 6/2010 Sutardja et al. ..... 257/3
7,897,061 B2 3/2011 Dysard et al.
8,097,575 B2 * 1/2012 Durrant ..... 510/175
8,318,042 B2 * 11/2012 Kaixie et al. ..... 252/79.1
8,460,474 B2 * 6/2013 Barr et al. ..... 134/3
2002/0042200 A1 * 4/2002 Fawcett ..... 438/692
2004/0152318 A1 * 8/2004 Fukushima et al. ..... 438/689
2006/0000808 A1 * 1/2006 Seki et al. ..... 216/88
2006/0288929 A1 * 12/2006 Slack et al. ..... 117/89
2007/0178700 A1 * 8/2007 Dysard et al. ..... 438/689
2009/0137191 A1 * 5/2009 Lee ..... 451/36
2010/0130013 A1 * 5/2010 Liu et al. ..... 438/693
2012/0164923 A1 * 6/2012 Jiang et al. ..... 451/56
2012/0190278 A1 * 7/2012 Shao et al. ..... 451/60
2012/0309278 A1 * 12/2012 Chen et al. ..... 451/444

FOREIGN PATENT DOCUMENTS

CN 1627547 A 6/2005
WO WO 2010060004 A2 * 5/2010

* cited by examiner

*Primary Examiner* — Lee D Wilson
*Assistant Examiner* — Marc Carlson
(74) *Attorney, Agent, or Firm* — Anova Law Group, PLLC

(57) ABSTRACT

A method for cleaning a polishing pad includes dispensing a first amount of deionized water on the polishing pad; cleaning the polishing pad with an acidity/alkalinity solution after dispensing the first amount of deionized water on the polishing pad; rinsing the polishing pad with a second amount of deionized water after cleaning the polishing pad with the acidity/alkalinity solution; removing the acidity/alkalinity solution from the polishing pad. In a subsequent CMP process, the method includes polishing a GST material device for obtaining an improved performance of the GST material device.

6 Claims, 2 Drawing Sheets

METHOD FOR CLEANING A POLISHING PAD

CROSS-REFERENCES TO RELATED APPLICATIONS

The present application claims the priority of Chinese Patent Application No. 201010604743.1, entitled "METHOD FOR CLEANING A POLISHING PAD", filed Dec. 23, 2010, the entire disclosure of which is incorporated herein by reference.

BACKGROUND OF THE INVENTION

1. Field of the Invention

The present invention relates to the field of semiconductor manufacture, and particularly, to a method for cleaning a polishing pad.

2. Background of the Invention

Nowadays, phase-change memory technology is proposed as a new nonvolatile memory technology for new applications. The phase-change memory technology is superior to flash memory technology in many aspects, such as read/write speed, read/write frequency, data hold time, unit area and multilevel storage, and is a hot-spot of nonvolatile memory research currently. The technology of phase change memory makes sustainably progress to become more competitive in mainstream nonvolatile memory products.

An alloy solid phase-change material, for example a GST (e.g., Ge2Sb2T25) material that comprises Ge, Se and Sb, is employed in phase-change memory devices.

In prior art, the GST material is often patterned by etching. However, when critical dimension of the patterns decreases, the GST material can not be patterned as desired by etching. Chemical Mechanical Polishing (CMP) can be an advantageous solution.

A CMP apparatus typically comprises a head and a platen. A polishing pad is provided on the platen. During CMP, a device is fixed on the platen, and has a to be polished surface in physical contact with the platen and an opposite surface pressed downwardly by the head. Slurry is dispensed while the platen and the head respectively rotate during the process of polishing. Polishing speed is adjustable with down-force of the head and selectivity of the slurry. The slurry comprises chemical reagents, for example, $SiO_2$, $Al_2O_3$, $H_2O_2$, BTA and/or the like. In general, before polishing another device, the polishing pad is cleaned with the slurry after polishing a device for removing residual byproducts.

FIGS. 1 and 2 are schematic cross-sectional views of a CMP apparatus for showing a conventional CMP process of polishing a GST material.

Referring to FIG. 1, a substrate 10 is provided. A dielectric layer 11 is formed on the substrate 10. An opening is defined in the dielectric layer 11, and is filled with GST material 12. The GST material 12 covers the dielectric layer 11 and serves as a phase change material layer for storing data. Referring to FIG. 2, the GST material 12 is polished by CMP to expose the dielectric layer 11. However, polishing the GST material device according to conventional art does not provide satisfactory performance.

BRIEF SUMMARY OF THE INVENTION

Embodiments of the present invention provide a method for polishing a GST material device using CMP, which completely removes residues on the polishing pad so that a GST material device can be polished with a smooth surface in a subsequent CMP process so that performance of the GST material device can be improved.

According to one embodiment of the invention, a method for cleaning a polishing pad comprises dispensing a first amount of deionized water on the polishing pad; cleaning the polishing pad with an acidity/alkalinity solution after dispensing the first amount of deionized water on the polishing pad; rinsing the polishing pad with a second amount of deionized water after cleaning the polishing pad with the acidity/alkalinity solution; and removing the acidity/alkalinity solution and the deionized water from the polishing pad.

Optionally, the polishing pad is used to polish a GST material device before dispensing deionized water on the polishing pad.

Optionally, cleaning the polishing pad with the acidity/alkalinity solution after dispensing deionized water on the polishing pad includes rotating a platen with a rotation speed smaller than 30 RPM, flowing the acidity/alkalinity solution with a flow rate greater than 300 ml/min, and a cleaning time greater than 60 s.

Optionally, rinsing the polishing pad with the second amount of deionized water after cleaning the polishing pad with the acidity/alkalinity solution, includes rotating a platen with a rotation speed smaller than 30-80 RPM, flowing the second amount of deionized water with a flow rate greater than 300 ml/min, and a rinsing time greater than 60 s.

Optionally, removing the acidity/alkalinity solution and the deionized water from the polishing pad uses a centrifugal force generated by rotating a platen.

Optionally, removing the acidity/alkalinity solution from the polishing pad includes rotating a platen with a rotation speed greater than 80 RPM.

Optionally, the acidity/alkalinity solution is selected from a group of sulfur solution, phosphoric acid solution, muriatic acid solution, and thermokalite solution.

Optionally, the phosphoric acid solution has a concentration ranging from about 0.01 to about 3 weight percent.

Optionally, the sulfur solution has a concentration ranging from about 0.01 to about 3 weight percent.

Optionally, the muriatic acid solution has a concentration ranging from about 0.01 to about 3 weight percent.

Optionally, the thermokalite solution has a concentration ranging from about 0.01 to about 3 weight percent.

In an embodiment of the present invention, after a GST material device is polished by the polishing pad, deionized water is used to remove byproducts remained on the polishing pad. Byproducts may not be completely removed by deionized water. The acidity/alkalinity solution is therefore dispensed on the polishing pad for dissolving the byproducts remained on the polishing pad. Subsequently, deionized water is dispensed on the polishing pad for dissolving the byproducts remained on the polishing pad. Finally, the platen is rotated to remove solution with the deionized water from the polishing pad. By this means, residual byproducts are completely cleaned from the polishing pad. In a subsequent CMP process, the polishing pad may smoothly polish another GST material device. Thus performance of the thus polished GST material device can be improved.

BRIEF DESCRIPTION OF THE DRAWINGS

The foregoing and other objects, features and advantages of the invention will be more apparent from the detailed description of embodiments of the present invention as shown in the accompanying drawings, in which identical reference numerals denote the same component. The drawings are not to scale and focus on the main principles of the invention.

DETAILED DESCRIPTION OF THE INVENTION

Figure 1:
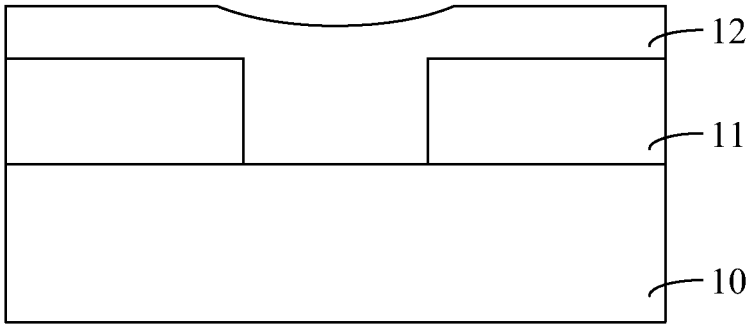
Fig. 1 (prior art)
FIGS. 1 and 2 are cross-sectional views of a CMP apparatus showing a conventional CMP process of polishing GST material.
Figure 2:
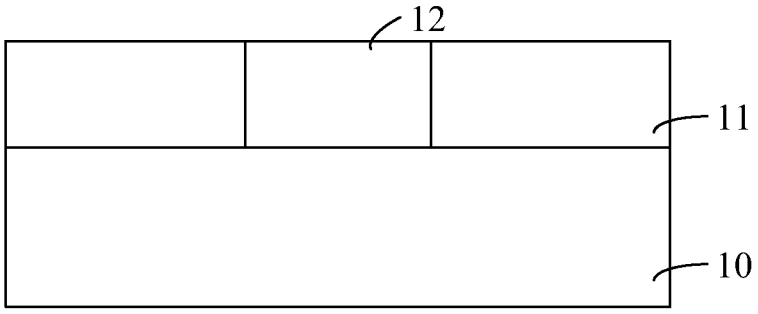
Fig. 2 (prior art)
Figure 3:
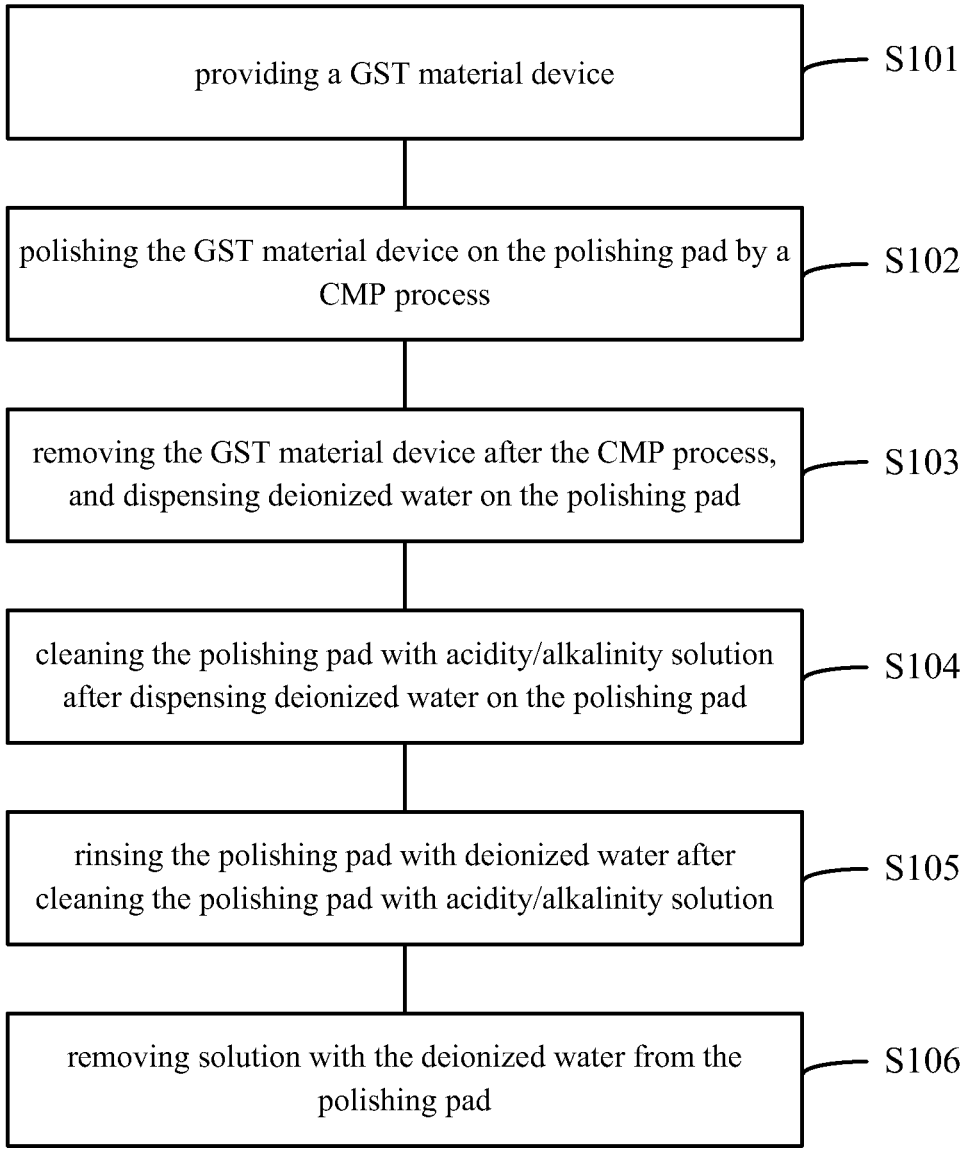
FIG. 3 is a flow chart illustrating a process of cleaning a polishing pad according to an embodiment of the present invention.

Numerous design details are described hereinafter for a better understanding of the invention. However, the invention can be implemented in other ways different from those described herein, and those skilled in the art can make modifications or alternations without departing from the scope of the invention. Therefore, the invention shall not be limited to the embodiments described below.

A conventional CMP method does not reliably polish a memory device to obtain acceptable performance. For a long period of time, there is no solution for this problem. Many researches have been carried out to change deposition process of the phase-change material to improve storage performance, however, reliable performance of such memory devices has not been obtained. Other researches focus on limiting damage to the phase change material during CMP, and correspondingly attempt to change process parameters or abrasive slurry for reducing damage. However, reliable performance of the memory device often can not be obtained. The present invention provides a cleaning method of the polishing pad to improve the performance of a GST material device. According to embodiments of the present invention, a polishing pad is cleaned after a GST material is polished by CMP. Residues on the polishing pad can be completely cleaned, thus reducing and/or eliminating an uneven polishing surface of the polishing pad. In the subsequent CMP process, a GST material device may be polished smoothly, and performance of the GST material device can be improved.

According to embodiments of the present invention, a method for cleaning polishing pad comprises dispensing a first amount of deionized water on the polishing pad; cleaning the polishing pad with an acidity/alkalinity solution after dispensing the first amount of deionized water on the polishing pad; rinsing the polishing pad with a second amount of deionized water after cleaning the polishing pad with the acidity/alkalinity solution; and removing solution and the deionized water from the polishing pad.

According to an embodiment of the present invention, after a GST material device is polished by the polishing pad, deionized water is used to remove byproducts remained on the polishing pad. Byproducts may not be completely removed by the deionized water. An acidity/alkalinity solution is therefore dispensed on the polishing pad for dissolving the byproducts remained on the polishing pad. Subsequently, deionized water is dispensed on the polishing pad for dissolving the byproducts remained on the polishing pad. Finally, the platen is rotated to remove the acidity/alkalinity solution with the deionized water from the polishing pad. By this means, residual byproducts are completely removed from the polishing pad. In a subsequent CMP process, another GST material device may be smoothly polished by the polishing pad. Thus, performance of the GST material device can be improved after being polished by CMP.

An embodiment of the present invention is now described in detail with reference to embodiments illustrated in the drawings.

According to an embodiment, a method for cleaning polishing pad comprises:

S101: providing a GST material device. In one embodiment, the GST material device includes a substrate and a dielectric layer on the substrate. An opening is defined in the dielectric layer. A GST material is filled in the opening and covers the dielectric layer.

S102: polishing the GST material device on the polishing pad by a CMP process.

S103: removing the GST material device after the CMP process, and dispensing deionized water on the polishing pad.

S104: cleaning the polishing pad with an acidity/alkalinity solution after dispensing deionized water on the polishing pad.

S105: rinsing the polishing pad with deionized water after cleaning the polishing pad with acidity/alkalinity solution.

S106: removing the acidity/alkalinity solution and the deionized water from the polishing pad.

In one embodiment, the GST material device includes a substrate and a dielectric layer on the substrate. An opening is defined in the dielectric layer. The GST material is filled in the opening and covers the dielectric layer.

A specific embodiment of the present invention is described below.

In step S101, a GST material device is provided. The GST material device includes a substrate and a dielectric layer on the substrate. An opening is defined in the dielectric layer. A GST material is filled in the opening and covers the dielectric layer.

The etching selectivity of material of the dielectric layer relative to the GST material is relatively large. Thus, during a CMP process, polishing may be performed only on a surface of the dielectric layer.

In step S102, the GST material device may be polished using a CMP process.

In step S103, the GST material device is removed after the CMP process. Deionized water is dispensed on the polishing pad for removing byproducts produced during the CMP process.

The byproducts comprise, for example dielectric material and GST material that may fall off during the CMP process. The fall-off GST material during the CMP process may include germanium and stibonium, which may be oxidized. The germanium oxide and stibonium oxide may be dissolvable in the deionized water and thus can be removed from the polishing pad in the step S103. The titanium metal which has chemical stability and oxidation stability is not dissolvable in the water and tends to reside on the polishing pad.

In step S104, after dispensing deionized water on polishing pad, the acidity/alkalinity solution is dispensed on the polishing pad for dissolving the byproducts remained on the polishing pad.

According to one embodiment of the present invention, the acidity/alkalinity solution is selected from a group of sulfur solution, phosphoric acid solution, muriatic acid solution and thermokalite solution. The phosphoric acid solution has a concentration of about 0.01 to about 3 wt %. The sulfur solution has concentration of about 0.01 to about 3 wt %. The muriatic acid solution has a concentration of about 0.01 to about 3 wt %. The thermokalite solution has a concentration of about 0.01 to about 3 wt %.

In one embodiment, in step S104, a rotation speed of the platen is smaller than 30 RPM, a flow rate of the solution is larger than 300 ml/min, and a cleaning time is larger than 60 s.

The titanium metal may be dissolve in the acidity/alkalinity solution that can be, for example, a sulfur solution, a phosphoric acid solution, a muriatic acid solution, or a thermokalite solution.

In step S105, after cleaning the polishing pad with the acidity/alkalinity solution, deionized water is used to rinse the polishing pad for removing residues on the polishing pad.

In one embodiment, in step S105, a rotation speed of the platen is smaller than 30-80 RPM, a flow rate of the deionized water is larger than 300 ml/min, and a cleaning time is larger than 60 s.

In step S106, the platen is rotated for removing the acidity/alkalinity solution with the deionized water from the polishing pad.

In one embodiment, in step S106, the solution with the deionized water remained on the polishing pad is removed by centrifugal force generated by rotating the platen. In a preferable embodiment, the rotation speed of the platen is larger than 80 RPM.

In some embodiments, the deionized water on the polishing pad may be removed using other techniques such as oven dry or blow dry techniques.

By this method, residual byproducts are completely removed from the polishing pad after a CMP process. In a subsequent CMP process, a GST material device may be polished smoothly, and not be affected by residues on the polishing pad. Thus, performance of the GST material device can be improved after being polished by the subsequent CMP process.

The present invention has been disclosed above with reference to preferred embodiments thereof. It should be understood that the invention is presented by way of example, and not limitation. Those skilled in the art can modify and vary the embodiments without departing from the spirit and scope of the present invention.

What is claimed is:

1. A method for cleaning a polishing pad, comprising:

dispensing a first amount of deionized water on the polishing pad, after the polishing pad is used to polish a GST (Ge—Sb—Te) material device;

cleaning the polishing pad with a thermokalite solution to dissolve a polishing byproduct including titanium metal from the polishing pad after dispensing the first amount of deionized water on the polishing pad;

rinsing the polishing pad with a second amount of deionized water after cleaning the polishing pad with the thermokalite solution; and generating a centrifugal force to the polishing pad to remove the thermokalite solution with the deionized water from the polishing pad, after rinsing the polishing pad with the second amount of deionized water.

2. The method according to claim 1, wherein cleaning the polishing pad comprises:

rotating a platen with a rotation speed lower than 30 RPM; and flowing the thermokalite solution with a flow rate greater than 300 ml/min and a cleaning time greater than 60 s.

3. The method according to claim 1, wherein rinsing the polishing pad with the second amount of deionized water comprises:

rotating a platen with a rotation speed smaller than 30-80 RPM; and flowing the second amount of deionized water with a flow rate greater than 300 ml/min and a rinsing time greater than 60 s.

4. The method according to claim 1, wherein generating the centrifugal force comprises rotating a platen.

5. The method according to claim 4, wherein rotating the platen comprises a rotation speed larger than 80 RPM.

6. The method according to claim 1, wherein the thermokalite solution has a concentration ranging from about 0.01 to 3 weight percent.

* * * * *